United States Patent [19]

Bunch, Jr.

[11] Patent Number: 5,076,555

[45] Date of Patent: Dec. 31, 1991

[54] APPARATUS FOR PARTIALLY SEVERING STRIP OF PAPER ALONG LINES OFFSET FROM LINES OF WEAKENING IN THE PAPER

[76] Inventor: Earnest B. Bunch, Jr., 9619 N. 21st Dr., Phoenix, Ariz. 85021

[21] Appl. No.: 557,905

[22] Filed: Jul. 25, 1990

[51] Int. Cl.[5] ..... B41L 1/32

[52] U.S. Cl. ..... 270/39; 493/415; 225/4

[58] Field of Search ..... 270/31, 39, 52.5; 493/413–415, 430; 225/4, 1, 100, 106; 83/92, 90

[56] References Cited

U.S. PATENT DOCUMENTS 3,913,904 10/1975 Occhetti ..... 270/39

4,623,136 11/1986 Bunch, Jr. ..... 270/39

4,730,762 3/1988 Felix ..... 270/39

*Primary Examiner*—Edward K. Look

*Assistant Examiner*—Therese M. Newholm

*Attorney, Agent, or Firm*—Tod R. Nissle

[57] ABSTRACT

A stationery folding machine having a dispensing roller which directs a continuous strip of paper into an oscillating mechanism which distributes successive lines of weakening formed in the paper in substantially opposite directions and having additional mechanisms for creasing the distributed paper along lines of weakening to produce continuous form stationery. Before the paper enters the oscillating mechanism, the machine partially severs the strip of paper along successive transverse lineations. The partially severed lineations are pulled apart when the strip of paper enters the oscillating mechanism.

5 Claims, 6 Drawing Sheets

FIG. 4
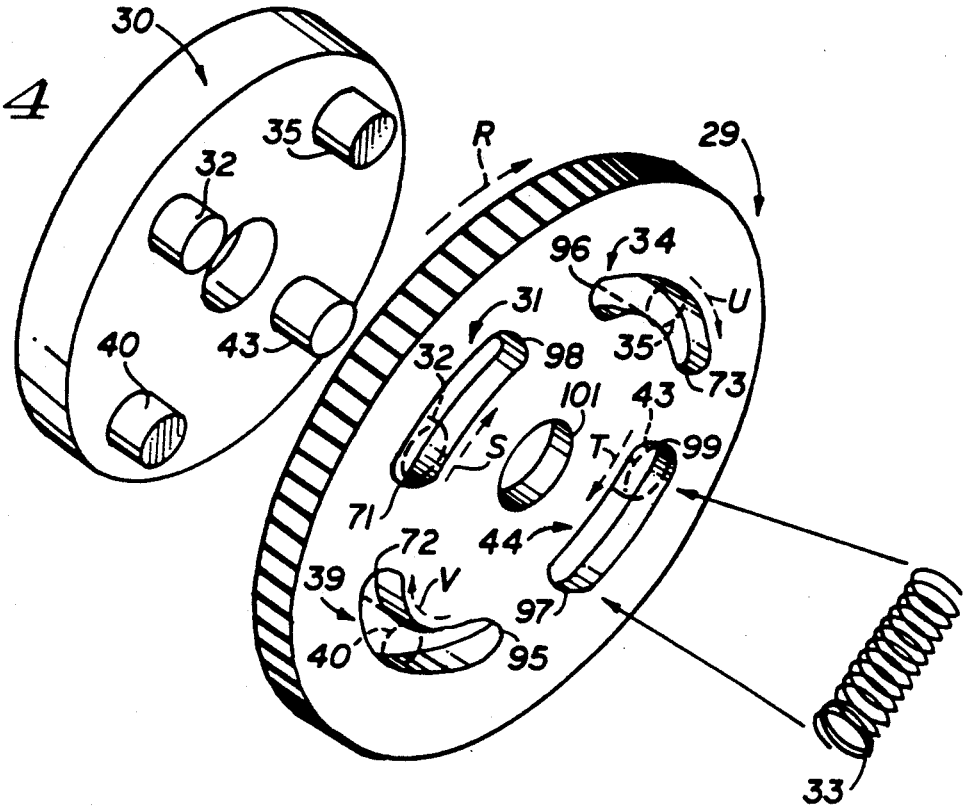
FIG. 5A
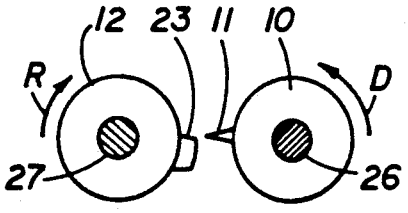
FIG. 5B
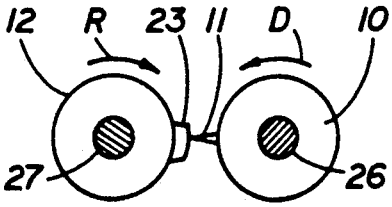
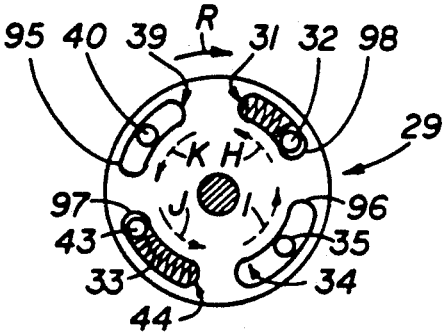
FIG. 6A
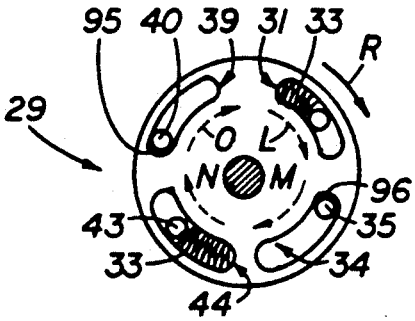
FIG. 6B

APPARATUS FOR PARTIALLY SEVERING STRIP OF PAPER ALONG LINES OFFSET FROM LINES OF WEAKENING IN THE PAPER

This invention relates to apparatus for producing continuous form stationery by folding a strip of paper along transverse lines of weakening formed therealong and for severing the strip of paper along selected transverse liens.

More particularly, the invention concerns an improved stationery folding machine of the type having a dispensing roller which directs a continuous strip of paper into a mechanism which distributes successive lines of weakening formed in the paper in substantially opposite directions and having additional mechanisms for creasing the distributed paper along the lines of weakening to produce continuous form stationery.

In another respect, the invention concerns an improved paper folding machine of the type described which severs the paper along selected transverse lineations before the paper is distributed in substantially opposite directions and folded.

Spiral paper folding machines and other similar types of folding machines are well known in the art. Spiral paper folding machines fold in a zig-zag fashion a strip of paper along transverse lines of weakening formed therealong to produce continuous form stationery. In the spiral folding machine an oscillating mechanism, or chute, distributes successive lines of weakening formed in the paper in substantially opposite directions. The paper distributed by the chute is received and folded by spirals and beaters. The folded paper is dispensed from the spirals and beater onto a table or stack of paper.

Cutting a strip of paper along transverse lineations before the paper enters the oscillating chute is known in the art, as demonstrated by European Patent No. 187,344 to Jos. Hunkeler. Cutting the paper in a spiral folding machine while the paper is in the spirals is also known in the art, as demonstrated by my U.S. Pat. No. 4,915,644. Lastly, cutting paper after it has been folded is also known in the art, as evidenced by U.S. Pat. No. 4,702,135 to Kwasnitza and U.S. Pat. No. 4,508,527 to Uno et al.

A particular problem associated with severing a strip of paper before it is dispensed into the chute is that it is difficult to control the two loose ends of paper which are produced when the paper is severed. The loose ends can jam the spiral folding machine or become bent or damaged as the paper passes into and through the chute.

Accordingly, it would be highly desirable to provide an improved spiral paper folding machine which would permit a strip of paper to be severed along a transverse lineation before the paper was dispensed for folding and which would significantly reduce the likelihood that the severed paper would jam in the folding machine or be damaged prior to folding of the paper.

Therefore, it is a principal object of the invention to provide an improved apparatus for producing continuous form stationery by distributing successive lines of weakening formed in the paper in substantially opposite directions and by then creasing the distributed paper along the lines of weakening to produce continuous form stationery.

Another object of the invention is to provide an improved paper folding machine of the type described which severs paper along transverse lineations before the paper is dispensed for folding and which maintains control of the paper after it is severed so that the likelihood of the severed paper jamming in the folding machine is reduced.

These and other, further and more specific objects and advantages of the invention will be apparent to those skilled in the art from the following detailed description thereof, taken in conjunction with the drawings, in which:

FIG. 4 is an enlarged perspective view illustrating a portion of the mechanism of FIG. 3;

FIGS. 5A and 5B are side views illustrating the mode of operation of the mechanism of FIG. 3;

FIGS. 6A and 6B are side views illustrating gear retarding components of the mechanism of FIG. 3;

Briefly, in accordance with my invention, I provide an improved apparatus for producing continuous form stationery by folding a strip of paper along transverse lines of weakening formed therein. The apparatus includes frame means; oscillating guide means mounted on the frame means for alternately distributing successive lines of weakening in the paper in substantially opposite directions; means for feeding paper in the guide means at a predetermined speed; and, folding means carried on the frame and operatively associated with the oscillating guide means for urging the paper distributed by the guide means into a folded condition. The guide means, feeding means and folding means generally move in synchronous relationship during operation of the apparatus. The improvement in the apparatus comprises means for severing the paper along at least one selected transverse lineation before the lineation is distributed by the oscillating guide means to the folding means. The severing means includes cutting means for partially severing the strip of paper along the selected transverse lineation prior to the lineation passing into the oscillating guide means; and, tensioning means mounted on the oscillating guide means to increase the tension pulling the strip of paper through the oscillating guide means to cause the strip of paper to pull apart and completely sever along said selected transverse lineation partially severed by said cutting means.

Figure 1:
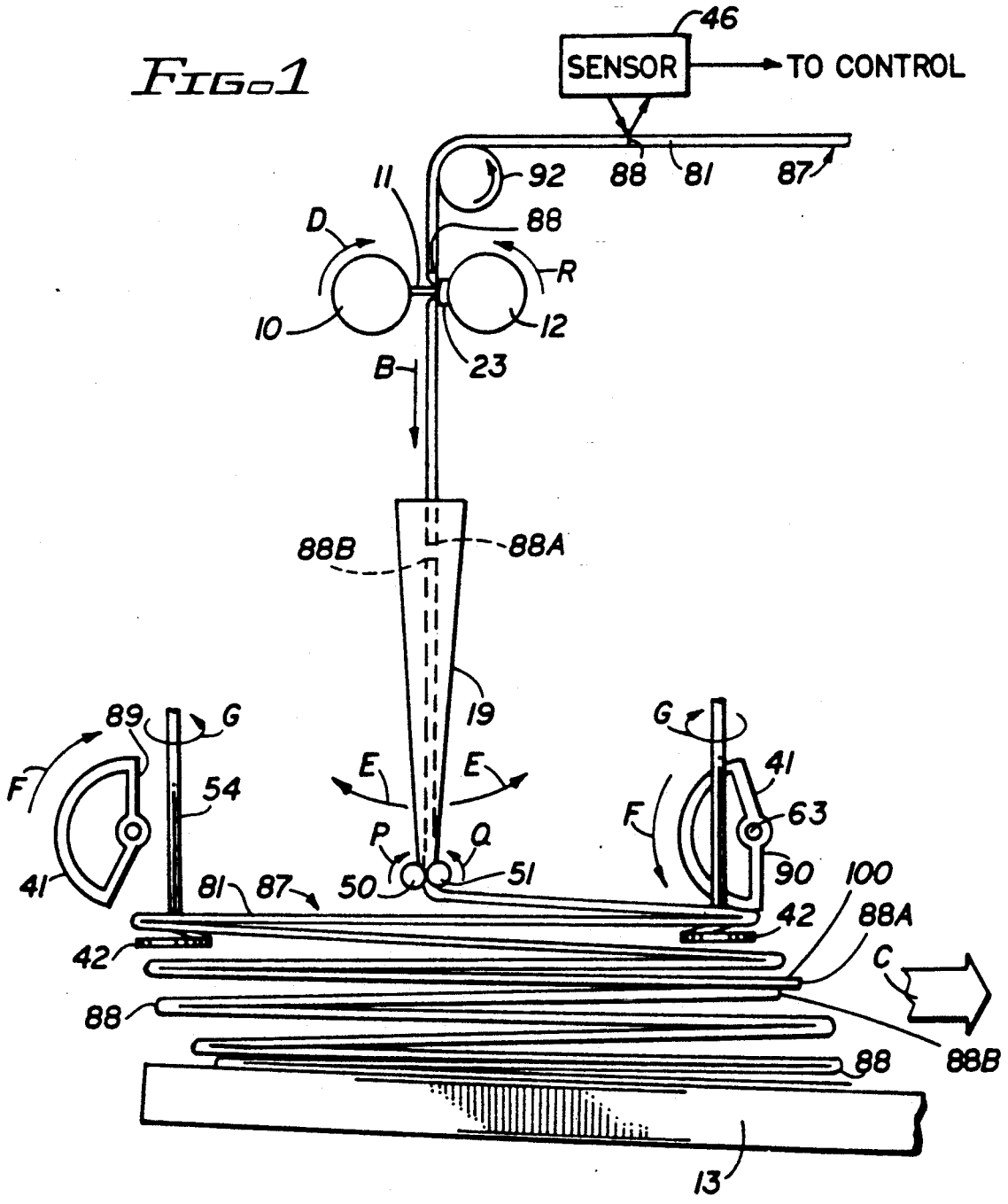
FIG. 1 is a schematic view illustrating a spiral folding machine constructed in accordance with the principles of the invention.
Figure 3:
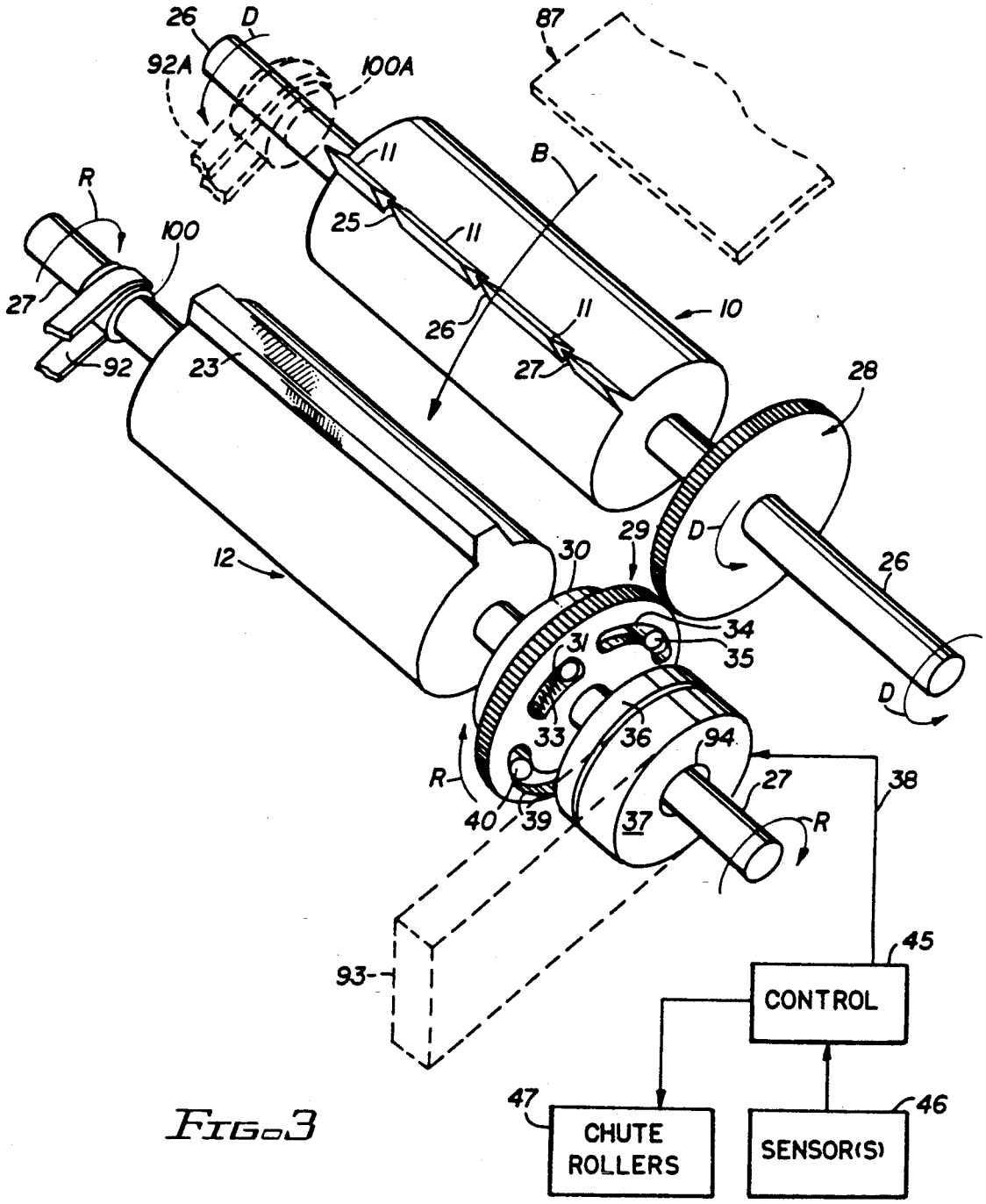
FIG. 3 is a perspective view illustrating the presently preferred mechanism for partially severing a strip of paper before the paper enters the chute.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 is a diagram of a spiral paper folding machine including a chute 19, rollers 50 and 51 on chute 19, spirals 42, beaters 41, feed roller 88, sensor 46, and conveyor table 13, each of which is well known in the art. Spirals 42 rotate in the directions indicated by arrows G while beaters 41 rotate in the directions indicated by arrows F. Knife edge 11 is fixedly attached to roller 10 while anvil 23 is fixedly attached to roller 12. Roller 10 rotates in the direction of arrow D. Roller 12 rotates in the direction of arrow R at the same speed as roller 10. Feed roller 92 dispenses paper intermediate rollers 10 and 12 and into chute 19. Rollers 50 and 51 rotate in the directions indicated by arrows P and Q and draws paper strip 87 therebetween to dispense paper from chute 19 as chute 19 oscillates in the directions indicated by arrows E. Paper folded and dispensed by spirals 42 is moved in the direction of arrow C by conveyor table 13. Sensor 46 detects a line of weakening 88 or a mark or some other reference point on paper 87 which is moving by sensor 46. When sensor 46 detects a line of weakening or some other reference point on paper strip 87, it sends a signal to control 45 (FIG. 3). Control 45 periodically causes rollers 10 and 12 to partially sever strip 87 along a selected transverse lineation and causes rollers 50 and 51 to momentarily increase their speed of rotation to increase the tension on strip 87 and cause strip 87 to completely sever along the transverse lineation which was earlier partially severed by blade 11 and anvil 23.

Gear trains and motors for synchronously driving roller 92, rollers 10 and 12, chute 19, beaters 41, spirals 42, and rollers 50 and 51 are well known in the art, as are means for driving the belts on table 13, and are not described in detail herein.

Figure 2:
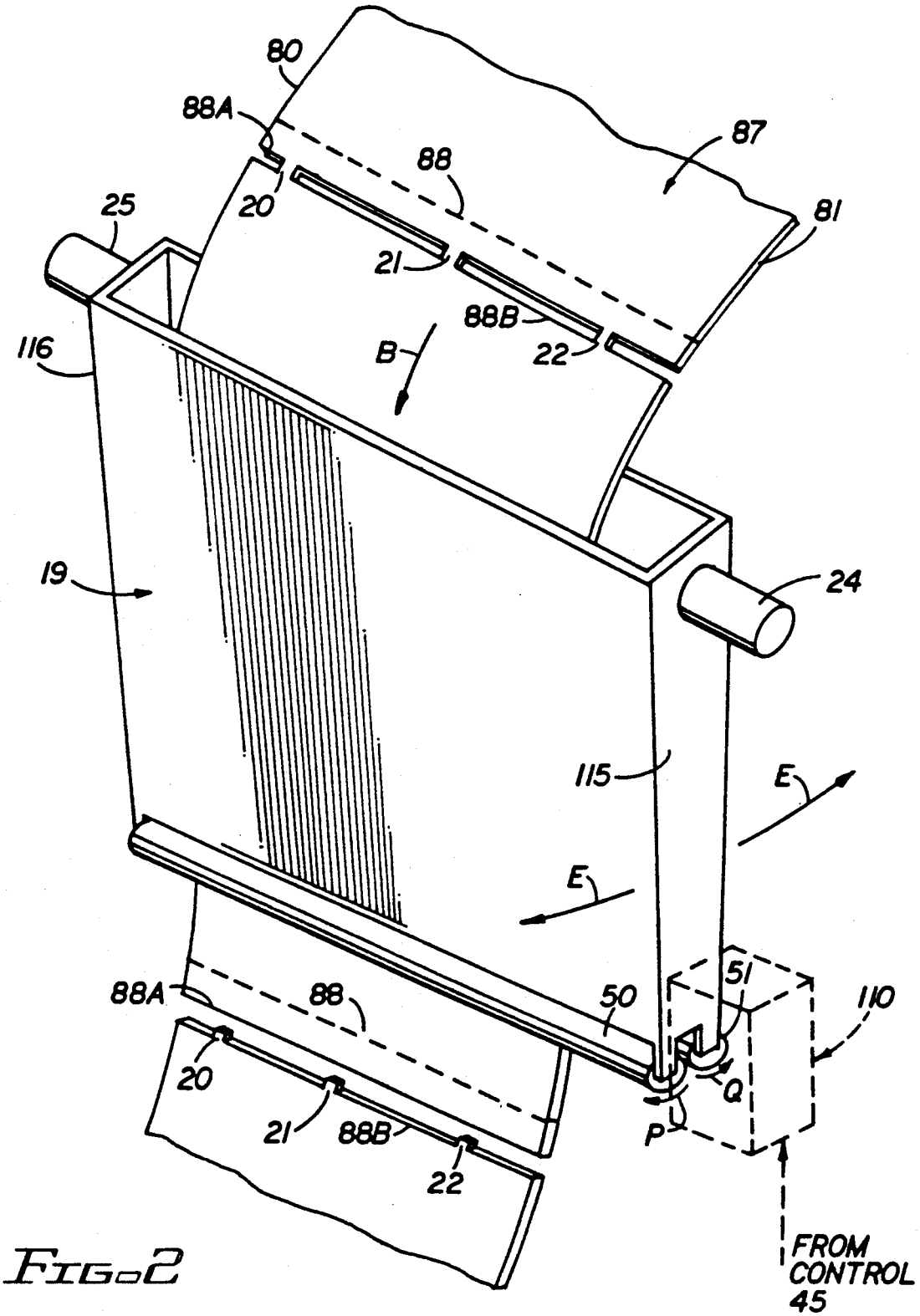
FIG. 2 is an enlarged view of the chute of the spiral paper folding machine of FIG. 1 illustrating how a strip of paper is severed along a transverse lineation while the transverse line is passing through the chute.

As shown in FIG. 2, the strip of paper 87 is presently preferably partially severed by knife edge 11 along transverse lineations which extend from one edge 80 to the other opposed parallel edge 81 of strip 87 and which are parallel to and offset from transverse lines of weakening or perforation 88 formed at equally spaced intervals along paper strip 87. After strip 87 is cut along a transverse lineation by edge 11, small tabs 20 to 22 remain which function to hold opposing edges 88A and 88B together. After tabs 20 to 22 pass into chute 29, the speed of rollers 50, 51 is momentarily increased from their normal running rotational speed. When the speed of rollers 50 and 51 is momentarily increased from their normal running rotational speed, the rollers 50 and 51 increase the tension pulling paper strip 87 in the direction of arrow B and cause tabs 20 to 22 to tear or break free from edge 88A and/or edge 88B.

In FIG. 2 the space between opposed edges 88A and 88B is exaggerated for the sake of clarity. The space between edges 88A and 88B normally appears to the human eye to be a small cut line or slit. Similarly, the size of tabs 20 to 22 is larger than normal. The size and number of tabs 20 to 22 can vary as long as the tabs interconnect edges 88A and 88B until the tabs 20 to 22 enter the chute and as long as the increase in rotational speed of rollers 50 and 51 causes tabs 20 to 22 to separate from edges 88A and 88B when the tabs are in the chute.

The magnetic brake system utilized to operate rollers 10 and 12 is illustrated in more detail in FIG. 3 in which roller 10 and toothed gear 28 are fixedly mounted on and rotate simultaneously with shaft 26. The gaps or spaces 25, 26, 27 along edge 11 allow tabs 20 to 22, respectively, to be formed when edge 11 presses paper strip 87 against anvil 23 and partially severs the strip 87. Cylindrical roller 12, cylindrical collar 30, and cylindrical member 36 are fixedly mounted on and rotate simultaneously with shaft 27. Roller 10 and gear 28 are fixedly mounted on and rotate simultaneously with shaft 26. Toothed gear 29 is slidably rotatably mounted on shaft 27. Belt 92 provides motive power for and rotates shaft 27 in the direction of arrow R. Gear 29, which also normally simultaneously rotates with shaft 27 in the direction of arrow R, transmits motive power to gear 28 to rotate gear 28 and shaft 26 in the direction of arrow D. Although not shown, the distal ends of shafts 26 and 27 are journalled for rotation in the walls of a frame such that rollers 10 and 12 are positioned intermediate the walls. Electric magnet 37 is supported in fixed position by a frame indicated by dashed lines 93. Shaft 27 passes through aperture 94 formed through magnet 37. Magnet 37 is, as noted, stationery, and does not rotate with shaft 27. As will be further described below, a control 45 unit periodically causes 38 electricity to be delivered to magnet 37. When electricity is delivered to magnet 37, magnet 37 is activated and "grabs" member 36 to temporarily slow the rotation of rotation of member 36, shaft 27, and roller 12. When magnet 37 is temporarily activated and grasps member 36, gear 28 and axle 26 continue to rotate and gear 28 actually provides the motive power necessary to continue rotating gear 29 in the direction of arrow R while collar 30 is being braked by magnet 37. The functioning of collar 30 and gear 29 is further described below with reference to FIGS. 4 to 6.

FIG. 4 is an exploded view of collar 30 and gear 29 In FIG. 4, pins 32, 35, 40 and 43 are fixedly attached to and outwardly extend from collar 30. Pin 35 is slidably received by slot 34 in gear 29; pin 32 is slidably received by slot 31; pin 40 is slidably received by slot 39; and, pin 43 is slidably received by slot 44. The normal positions of pins 32, 35, 40 and 43 in slots 31, 34, 39, 44, respectively, is illustrated in FIG. 6A. When pins 32, 35, 40 and 43 are in the positions shown in FIG. 6A collar 30 is rotating gear 29 in the direction of arrow R and gear 29 is simultaneously rotating with axle 27, roller 12, and member 36. Gear 29 is also transmitting motive power to gear 28 to drive roller 10. As shown in FIG. 6A, springs 33 are carried in slots 31 and 44 and bear against pins 32 and 43. In FIG. 6A, however, springs 33 are not required to maintain pins 32 and 43 in position at one end of each pin's respective slot 31, 44. The torque generated on pins 32 and 43 when collar 30 rotates in the direction of arrow R forces the pins against the ends 98, 97 of slots 31 and 44 in the manner shown in FIG. 6A. Also, as shown in FIG. 6A, pins 35 and 40 are each positioned in a slot 34, 39 intermediate the ends of the slot. When gear member 29 is rotating with pins 32, 35, 40 and 43 positioned in the manner shown in FIG. 6A, rollers 10 and 12 rotate such that anvil 23 is slightly ahead of blade 11 (FIG. 5A) when anvil 23 and blade 11 make their closest approach. The purpose of activating magnet 37 is to momentarily slightly retard blade 23 such that blade 11 and anvil 23 meet in the manner illustrated in FIG. 5B and blade 11 therefore presses strip of paper 87 against anvil 23 and cuts the paper along portions of a selected transverse lineation.

The mechanism by which roller 12 and anvil 23 are slightly momentarily retarded is illustrated in FIG. 6B. FIG. 6B illustrates the position of gear 29 with respect to pins 32, 35, 40, 43 just after magnet 37 has been activated. When magnet 37 is activated, the rotation of axle 27 and collar 30 is slowed. While the rotation of collar 30 slows, the inertia of gear 28 and roller 10 tend to cause gear 29 to continue turning at its normal speed. As collar 30 slows with respect to gear 29, pins 32, 40, 43, 35 move in the direction of arrows H, K, J, I with respect to gear 29 (FIG. 6A). After pins 40 and 35 have moved far enough in the directions of arrows K and I, pins 40 and 35 abut against ends 95 and 96 of slots 39 and 34. While pins 32 and 43 move in the direction of arrows H and J, pins 32 and 43 compress springs 33.

At about the time pins 40 and 35 abut against ends 95 and 96, the anvil 23 and blade 11 are in the position illustrated in FIG. 5B and edge 11 is partially severing the strip of paper 87 along a selected transverse lineation. Shortly after the strip of paper is partially severed by blade 11, the electricity to magnet 37 is turned off, and springs 33 facilitate the movement of pins 32, 40, 43, 35 with respect to gear 29 in the direction of arrows L, 0, N, and M, respectively. Once magnet 37 is turned off and shaft 27 is free to turn at its normal speed, springs 33 facilitate the return of pins 32, 40, 43, 35 to the positions shown in FIG. 6A.

In an alternate embodiment of the invention, in FIG. 3 member 36 is eliminated from shaft 27, magnet 37 is positioned adjacent gear 29, and pins 32, 35, 40, 43 and collar 30 are fabricated from a non-magnetic material. Gear 29 is, as was member 36, fabricated from iron or some magnetic material. Further, instead of being positioned in the manner shown in FIG. 6A, the pins 32, 35, 43 and 40 are normally positioned in the manner indicated by dashed lines 32, 35, 43, and 40 in FIG. 4. A spring 33 is normally positioned in slot 44 intermediate end 97 and pin 43, and another spring is positioned in slot 31 intermediate end 98 and pin 32. In this alternate embodiment, when magnet 37 is activated, it grabs gear 29 and slows its travel in the direction of arrow R. When the travel of gear 29 is momentarily slowed, pin 32 moves in the direction of arrow S, compressing spring 33 between pin 32 and end 98; pin 43 moves in the direction of arrow T, compressing a spring 33 between pin 43 and end 97; pin 35 moves in the direction of arrow U until pin 35 contacts end 73; and, pin 40 moves in the direction of arrow V until pin 40 contacts end 72. At about the time pins 35 and 40 contact ends 73 and 72, anvil 73 and edge 11 are aligned in the manner shown in FIG. 5B and edge 11 partially severs a strip of paper which is intermediate edge 11 and anvil 23. Shortly after edge 11 partially severs strip of paper 87 along a transverse lineation, magnet 37 is turned off and springs 33 force gear 29 to move with respect to pins 32, 35, 40 and 43 such that pins 32, 35, 40, 43 return to the positions with respect to gear 29 that are illustrated in FIG. 4. In this alternate embodiment of the invention, when the magnet is turned on, roller 10 and blade 11 are slightly retarded. Consequently, when the magnet 37 is turned off, the edge 11 is slightly ahead of the anvil 23 at the closest point of approach of anvil 23 and edge 11. This contrasts to FIG. 5A, where the anvil is slightly ahead of the edge 11 at their closest point of approach.

The transverse lineation along which edge 11 partially severs the strip of paper 87 can correspond to a line of weakening 88 or can, in the manner shown in FIG. 2, be offset from a line of weakening 88. In practice, edge 11 usually makes a cut along a transverse lineation which is offset and spaced apart from a line of weakening 88 because operating rollers 10 and 12 to insure that a cut is made exactly on a line of weakening 88 can be difficult to accomplish on a consistent basis.

Control 45 activates magnet 37, i.e., sends electricity to magnet 37, when control 45 receives a signal from sensor 46. Sensor 46 detects equally spaced reference marks or points as paper strip 87 moves past sensor 46 (FIG. 1). Each time sensor 46 detects a reference point, the paper between rollers 10 and 12 is ready to be partially severed along a selected transverse lineation. At the same time, or just prior to the time, that control 45 activates magnet 37, control 45 also momentarily increases the speed of rotation of rollers 50 and 51. Increasing the speed of rotation of rollers 50 and 51 increases the tension on the paper passing through chute 19 and causes the tabs 20 to 22 bridging a pair of opposed cut edges 88A, 88B to tear or separate so that the strip of paper is completely severed between edges 88A, 88B. In FIG. 2, the edge 88A which has just been dispensed from the chute is completely severed from its opposing edge 88B.

Instead of using control 45, which in conventional fashion incorporates a microprocessor therein, magnet 37 can be manually activated using a switch to turn electricity to the magnet 37 on and off.

Instead of periodically momentarily increasing the speed of rollers 50, 51, the rollers 50 and 51 can continuously be rotated at a speed which tends to pull paper from between rolls 10 and 12 through the chute at a rate which is slightly greater than the rate at which roller 92 feeds paper intermediate rollers 10 and 12. Continuously running rollers 10 and 12 at a rotational rate which pulls paper from between rollers 10 and 12 faster than the rate at which the paper is fed into the rollers 10 and 12 by roller 92 tensions the paper strip 87 and facilitates the complete severing of the strip 87 along a line of partial severing produced by rollers 10 and 12 and edge 11. When, however, the rollers 50 and 51 are continuously run in an "overdrive" condition, it is more difficult to ensure that a partially severed transverse lineation is pulled apart inside the chute and is not pulled apart after the transverse lineation leaves the rollers 10, 12 and before the partially severed lineation enters the chute 19. Accordingly, it is presently preferred that the rotational speed of each roller 50 and 51 be increased from a normal rotational speed only when a partially severed transverse lineation is in chute 19 and is ready to be completely severed. Rollers 50 and 51 typically are of equal diameter and each rotate at the same speed.

Any of a variety of prior art motors and/or gearing arrangements can be utilized to momentarily periodically increase the speed of rotation of both rollers 50 and 51. In particular, a stepper motor could be utilized in a manner similar to that described in the copending application Ser. No. 462,766, filed Jan. 10, 1989 for "SPIRAL PAPER FOLDING MACHINE WITH AUTOMATIC CHANGE GEAR ADJUSTMENT".

Figure 7:
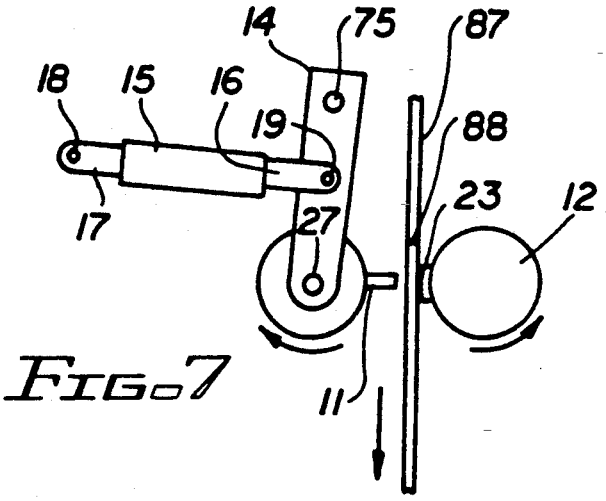
FIG. 7 is a side diagrammatic view of an alternate mechanism for partially severing a strip of paper before the paper enters the chute.
Figure 8:
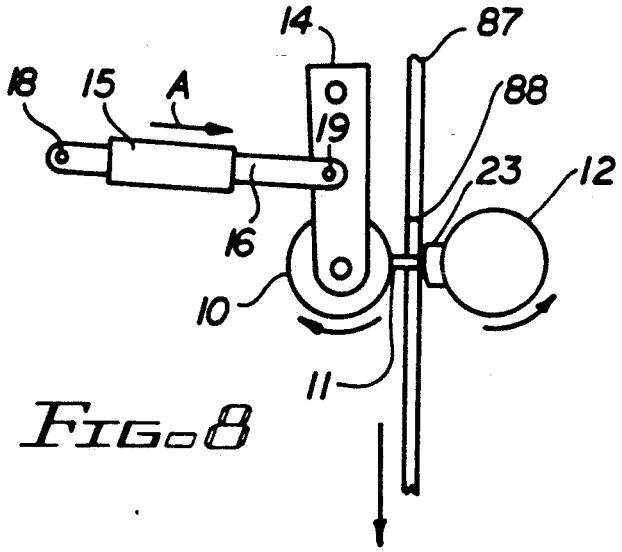
FIG. 8 is a side diagrammatic view further illustrating the mechanism of FIG. 7.

An alternate method of controlling rollers 10 and 12 in order to cut strip 87 at spaced apart parallel transverse lineations is illustrated in FIGS. 7 and 8. In FIGS. 7 and 8 rollers 10 and 12 each continuously rotate at an equal speed and knife edge 11 and anvil 23 are usually directly opposed and spaced apart from one another at their closed approach, illustrated in FIG. 7. One end of arm 14 is pivotally connected to fixed pivot point 75. One end of shaft 27 is journalled for rotation in the lower end of arm 14. The other end of shaft 27 (not visible) is journalled for rotation in an auxiliary arm which is identical in shape and dimension to arm 14 and which also has its upper end pivotally connected to a fixed pivot point. The distal end of arm 16 is pivotally connected to arm 14. The distal end of arm 17 is connected to fixed pivot point 18. The proximate end of arm 16 is attached to a piston (not visible) housed in pneumatic cylinder 15. When cylinder 15 is activated, the piston is displaced and arm 16 extends in the direction of arrow A and moves arm 14 and rotating roller 10 in the direction of arrow A. Pneumatic cylinder 15 is activated to extend arm 16 when edge 11 is at or near the position shown in FIG. 7, so that when cylinder 15 is activated, knife edge 11 is pressed against anvil 23 to partially sever strip 87 along a selected transverse lineation which presently is preferably offset and spaced away from a line of weakening or perforation 88. If desired, edge 11 can sever strip 87 along a line of weakening 88. After edge 11 makes a cut along a transverse lineation, cylinder 15 retracts arm 16 to the position shown in FIG. 7.

In FIG. 1, the position of sensor 46 is known, as is the distance from sensor 46 to rollers 10 and 12 and the spacing of lines of weakening 88 or other reference points along strip 87. When a reference point is identified by sensor 46, control 45 therefore knows the position of the closest line of weakening approaching rollers 10 and 12 and knows that if edge 11 is immediately used to partially sever strip 87, the cut made in strip 87 will, within a selected tolerance, be a certain distance from a line of weakening 88.

Rollers 50 and 51 can be positioned inside chute 19. Opposing belts or other means can be mounted on chute to pull and tension partially severed paper 87 which is moving from rollers 10 and 12 to chute 19. Shafts 24, 25 are journalled for rotation in the opposing walls of frame.

In FIG. 3, pulley 100 can, in the event belt 92 cannot compensate for the braking of shaft 27 which occurs when magnet 37 is activated, be replaced by a collar 30A—pulley 29A combination (not shown). Collar 30A is fixedly attached to shaft 27 and is identical in shape and dimension to collar 30. Collar 30A includes pins 32, 35, 40, 43. Pulley 29A is identical to gear 29 except that the teeth on the periphery of gear 29 are removed and replaced with a smooth cylindrical peripheral surface which receives belt 92 in the same manner which pulley 100 receives belt 92. Pulley 29A is not fixedly attached to shaft but instead, as does gear 29, includes an aperture which slidably receives shaft 27. Pulley 29A is therefore carried on shaft 27 but pulley 29A can, subject to interference by pins 32, 35, 40, 43 and springs 33, be rotated or free wheel at any desired speed with respect to shaft 27. If pulley 100 is replaced by a collar 30A—pulley 29A combination, then when magnet 37 is used to "grab" member 36 and slow the revolution of shaft 27 and collars 30A and 30, belt 92 continues to move at its normal speed, continues to turn the pulley 29A, and causes pins 32 and 43 to compress springs 33 in the manner illustrated in FIG. 6B until pins 35 and 40 seat in ends 96 and 95 of slots 34 and 39 of pulley 29A. In other words, the collar 30A—pulley 29A arrangement utilized with belt 92 functions in a manner similar to that illustrated in FIGS. 5 and 6 for the collar 30 and gear 29.

In another embodiment of the invention, the apparatus of FIG. 3 is utilized except that pulley 100 and belt 92 are removed from shaft 27. The motive power for shafts 26 and 27 is instead supplied by a belt 92A which turns pulley 100A and shaft 26 in the direction of arrows D. When belt 92A is utilized instead of belt 92, the collar 30 and gear 29 function in a manner similar to that earlier described. Activating magnet 37 slows the rotation of member 36 and collar 30 while gear 28 continues to turn gear 29 with respect to collar 30 and shaft 27 such that pins 32 and 43 compress springs 33 in the manner shown in FIG. 6B and such that pins 35 and 40 seat at ends 96, 95 of slots 34, 39. Once magnet 37 is turned off, springs 33 cause pins 32, 35, 40 and 43 to return to the positions in slots 31, 34, 39, and 44 shown in FIG. 6A. When the pins 32, 35, 40, 43 are positioned in slots 31, 34, 39, 44 in the manner shown in FIG. 6A, then anvil 23 is, as shown in FIG. 5A, offset from edge 11 at the closest point of approach of edge 11 and anvil 23 and edge 11 will not cut a strip of paper passing between edge 11 and anvil 23. When magnet 37 is activated to position pins 35 and 40 at ends 96 and 95, respectively, of slots 34 and 39, then edge 11 contacts anvil 23 in the manner illustrated in FIG. 5B and edge 11 partially severs a strip of paper which is passing between rollers 10 and 12. In FIG. 3, gear 28 is fixedly attached to and rotates simultaneously with shaft 26.

In FIGS. 1, 3, 5, 7 and 8, rollers 10 and 12 presently preferably turn at a speed which causes edge 11 anvil 23 to move at a speed generally equivalent to the speed of paper 87 moving intermediate rollers 10 and 12.

In order to intermittently increase the speed of rotation of rollers 50 and 51, a small motor 110 can be mounted on the lower portion of one side 115 of chute 19 in the manner indicated by dashed lines 110 in FIG. 2. Motor 110, the size of which is exaggerated in FIG. 2, oscillates with chute 19 in the directions indicated by arrows E. Motor 110 intermittently increases the speed of rollers 50 and 51 in order to tension paper passing through chute 19 to cause the paper to completely separate along partially cut lineations. One mechanism for using motor 110 to increase the rotational speed of a roller is illustrated in FIGS. 9 and 10.

Figure 9:
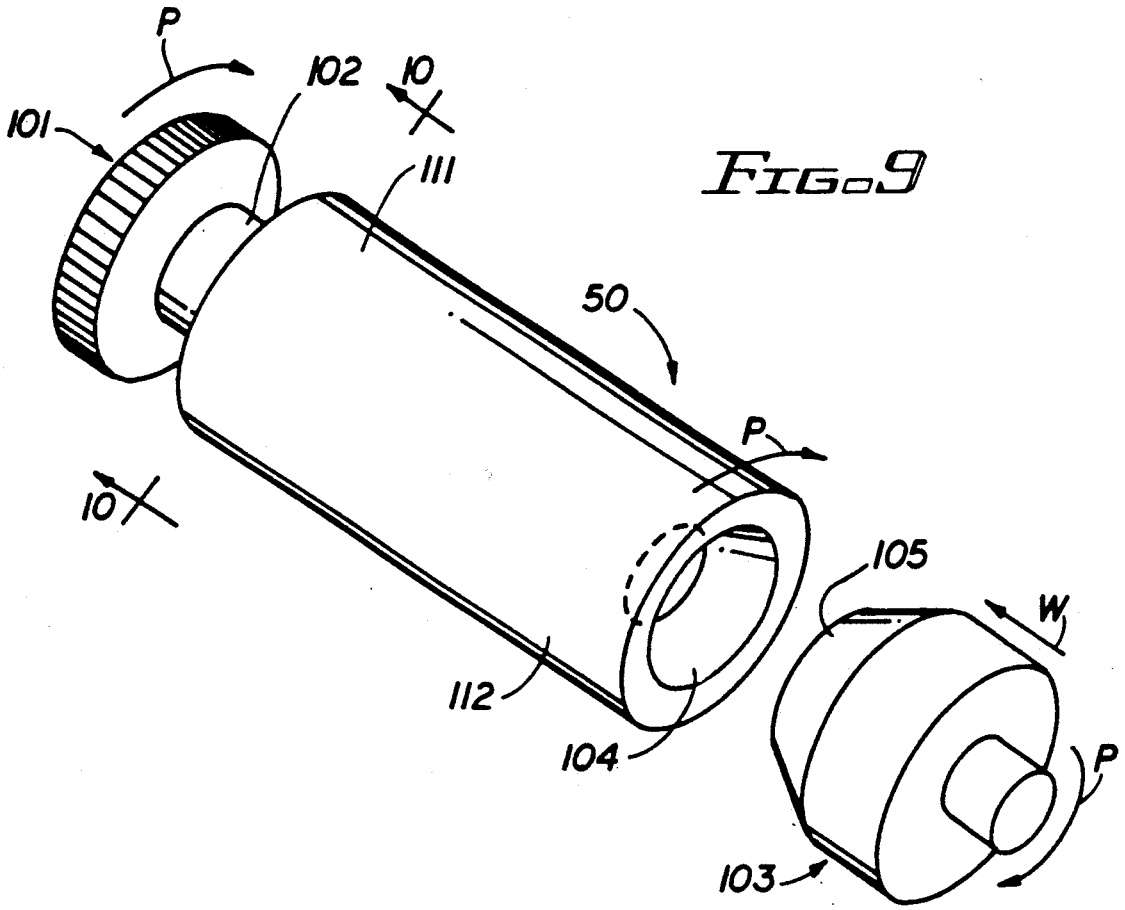
FIG. 9 is a perspective view illustrating apparatus for intermittently increasing the speed of rotation of a chute roller.
Figure 10:
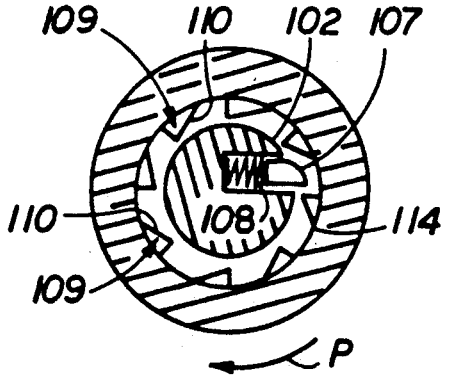
FIG. 10 is a section view of the chute roller of FIG. 9 taken along section line 10—10 thereof; and, FIG. 11 is an end view illustrating an alternate chute roller embodiment used in the practice of the invention.

In FIG. 9, roller 50 normally continuously rotates at a selected speed in the direction of arrow P. Although not shown in FIG. 9, opposing roller 51 rotates at the same speed as roller 50. A gear train (not shown) imparts motive power to gear 101 to turn gear 101 and shaft 102 in the direction of arrow P. Shaft 102 is fixedly attached to gear 101. As shown in FIG. 10, shaft 102 extends into one end 111, which is hollow, of roller 50. The inner cylindrical wall 114 of end 111 of roller 50 is lined with eight outwardly projecting equally spaced teeth 109 as depicted in FIG. 10. A pin 107 outwardly extends from an aperture formed in shaft 102. Spring 108 normally outwardly forces pin 107 against the cylindrical inner wall 114 of end 111. Under normal operating conditions, shaft 102 and roller 50 rotate simultaneously at an equivalent RPM. While rotating at an equivalent RPM, the distal tip of pin 107 bears against a tooth 109 in the manner illustrated in FIG. 10 and imparts motive power to roller 50 to rotate roller 50 in the direction of arrow P. When clutch 103 is used to increase the speed of rotation of roller 50 above the normal rotational speed of roller 50, shaft 102 continues rotating at its normal rotational speed. Since clutch 103 is causing roller 50 to rotate faster in the direction of arrow P than shaft 102, one or more teeth 109 move past pin 107. The sloped surface 110 of each tooth 109 forces pin 107 into shaft 102 and compresses spring 108. After each tooth 109 moves by pin 107, spring 108 causes pin 107 to move outwardly back into position against the inner cylindrical wall 114 of end 111. Once clutch 103 disengages from roller 50, pin 107 bears against a tooth 109 and continues to rotate roller 50 in the direction of arrow P at a normal rotational speed. Regardless of whether clutch 103 is engaging roller 50, gear 101 and shaft 102 generally continue to move at a selected normal rotational speed. Accordingly, pin 107 and teeth 109 form a type of reverse ratchet and pawl arrangement which permits roller 50 to be rotated at a speed greater than the speed of rotation of shaft 102 but which also prevents the speed of rotation of roller 50 from being less than the speed of rotation of shaft 102.

Clutch 103 is mounted in motor 110. Motor 110 (not shown in FIG. 9) turns clutch 103 in the direction of arrow P and displaces the clutch in the direction of arrow W when motor 110 receives a command from control 45. When clutch 103 is displaced in the direction of arrow W, conical surface 105 frictionally engages conical surface 104 and causes roller 50 to rotate at an RPM greater than the RPM at which shaft 102 rotates roller 50. Clutch 103 engages and turns roller 50 for a period of time along enough to sever a partially cut lineation which is traveling from rollers 10 and 12 toward the mouth of the chute 19 to be dispensed by chute 19. After the partially cut lineation has been pulled apart, motor 110 causes surface 105 of clutch 103 to disengage from surface 104 in a direction opposite that of arrow W. Once surface 105 disengages from surface 104, pin 107 presses against a tooth 109 and continues to turn roller 50 at its selected normal rotational speed. The selected normal rotational speed of rollers 50 and 51 causes points on the outer cylindrical surfaces of rollers 50 and 51 to move at about the same speed as the paper 87 dispensed into chute 19 by feed roller 92. A separate clutch can be provided for roller 51, or a belt or other means can interconnect rollers 50 and 51 such that roller 50 imparts motive power to roller 51 and causes roller 51 to rotate at the same RPM as roller 50. Although not shown, in utilizing the apparatus of FIG. 9, the ends 111 and 112 of roller 50 extend through and are journalled for rotation in the sides 116 and 115, respectively, of chute 19.

Figure 11:
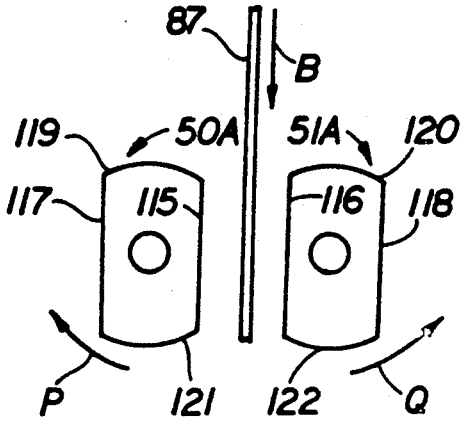

In another embodiment of the invention, illustrated in FIG. 11, rollers 50A and 51A are substituted for rollers 50 and 51. Rollers 50A and 51A are continuously rotated in the directions of arrows P and Q at a speed which is slightly greater than the speed at which roller 92 feeds paper into chute 19. When rollers 50A and 51A are in the position shown in FIG. 11, paper strip 87 passes between flats 115 and 116 and rollers 50A and 51A do not frictionally engage and tension paper 87. As rollers 50A and 51A continue to rotate, arcuate surfaces 119 and 120 frictionally engage paper 87 and tension the strip to completely sever the strip along a partially severed lineation. As can be appreciated from FIG. 11, arcuate pair 119-120 and arcuate pair 121-122 alternately intermittently frictionally engage and tension paper 87. When paper 87 is not engaged by and pressed between pair 121-122 or pair 119-120, the paper 87 is traveling in a direction B between opposed flat pair 115-116 or opposed flat pair 117-118 and is not tensioned.

As noted, paper strip 87 is preferably cut by edge 11 along lineations offset from lines of weakening 88. The lineations also preferably precede lines of weakening 88 in the manner illustrated in FIG. 2 and the lineations are partially cut so that less tension is required to separate the paper along a partially cut lineation than is required to separate the paper along a line of weakening 88. As a result, even if the tension generated by rollers 50 and 51 on paper in chute 19 is sufficient to separate paper 87 along a line of weakening, the paper 87 tends to completely sever along the partially cut lineation before it can separate along a line of weakening 88. The tension generated by rollers 50, 51 preferably, but not necessarily, is only sufficient to separate paper 87 along a partially cut lineation and not along a line of weakening 88. Each time the tension acting on paper 87 is increased by rollers 50 and 51 or some other means, there preferably is only a single partially cut lineation in the portion of paper strip 87 which precedes and is moving toward rollers 50, 51 and is tensioned by rollers 50 and 51. If there is more than one partially cut lineation in a portion or length of paper which is tensioned by rollers 50 and 51 to completely sever the paper 87, it is difficult to predict whether paper 87 will sever along each of or only one of the partially cut lineations.

Having described my invention in such terms as to enable those skilled in the art to understand and practise it, and having identified the presently preferred embodiments thereof, I claim:

1. In combination with apparatus for producing continuous form stationery by folding a strip of paper along transverse lines of weakening formed therein, said apparatus including frame means, oscillating guide means mounted on said frame means for alternately distributing successive lines of weakening in said strip of paper in substantially opposite directions, means for feeding said strip of paper into said guide means at a predetermined speed, folding means carried on said frame and operatively associated with said oscillating guide means for urging said strip of paper distributed by said guide means into a folded condition, said guide means, feeding means and folding means generally moving in synchronous relationship during operation of said apparatus, the improvement comprising means for severing said strip of paper along at least one selected transverse lineation before said selected transverse lineation is distributed by said oscillating guide means to said folding means, said severing means including (a) cutting means for partially severing said strip of paper along said selected transverse lineation prior to said lineation passing into said oscillating guide means; and, (b) tensioning means mounted on said oscillating guide means to tension said strip of paper moving through the oscillating guide means to cause said strip of paper to pull apart and completely sever along said selected transverse lineation partially severed by said cutting means, said tensioning means intermittently increasing said tension on said strip of paper to cause said strip of paper to pull apart and completely sever along said selected transverse lineation partially severed by said cutting means.

2. The combination of claim 1 wherein said tensioning means comprises (a) roller means for contacting and pulling said strip of paper through said guide means; and, (b) means for (i) rotating said roller means at at least one selected normal speed, and (ii) intermittently increasing the speed of rotation of said roller means to a speed greater than said one selected normal speed to cause said strip of paper in said guide means to pull apart and completely sever along said selected transverse lineation partially severed by said cutting means.

3. The combination of claim 1 wherein said tensioning means comprises (a) draw means for contacting and pulling said strip of paper through said guide means; and, (b) control means for causing said draw means to (i) pull said strip of paper through said chute at a first normal speed of travel, and (ii) intermittently increase the speed of travel of said strip of paper to a speed greater than said first normal speed of travel to cause said strip of paper in guide means to pull apart and completely sever along said selected transverse lineation partially severed by said cutting means.

4. The combination of claim 1 wherein said cutting means includes (a) a first roller having at least one cutting edge extending outwardly from said roller;

(b) a second roller having an anvil extending outwardly from said second roller;

said strip of paper passing intermediate said first and second rollers and being cut when said cutting edge presses said paper against said anvil.

5. The combination of claim 4 including means for (a) normally rotating said first roller out of synchronization with said second roller such that said cutting edge does not press said paper against said anvil at any time during the rotation of said first and second rollers; and, (b) intermittently altering the speed of rotation of at least one of said first and second rollers such that (i) said rollers are at least temporarily synchronized, and (ii) said cutting edge presses said paper against said anvil once per revolution of each of said rollers to partially sever said paper along said selected transverse lineation.

* * * * *